US010184742B2

(12) United States Patent
Gray

(10) Patent No.: US 10,184,742 B2
(45) Date of Patent: Jan. 22, 2019

(54) FIRE CONTROL MECHANISM FOR STRIKER-FIRED PISTOLS WITH ENHANCED SAFETY FEATURES

(71) Applicant: SIG SAUER, INC., Newington, NH (US)

(72) Inventor: Bruce Edward Gray, Spray, OR (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 15/406,674

(22) Filed: Jan. 14, 2017

(65) Prior Publication Data

US 2017/0321982 A1 Nov. 9, 2017

Related U.S. Application Data

(60) Provisional application No. 62/279,706, filed on Jan. 16, 2016.

(51) Int. Cl.

| | |
|---|---|
| ***F41A 17/72*** | (2006.01) |
| ***F41A 19/35*** | (2006.01) |
| ***F41A 19/31*** | (2006.01) |
| *F41C 3/00* | (2006.01) |

(52) U.S. Cl.

CPC ..... *F41A 17/72* (2013.01); *F41A 19/31* (2013.01); *F41A 19/35* (2013.01); *F41C 3/00* (2013.01)

(58) Field of Classification Search

CPC ..... F41A 17/17; F41A 19/35; F41C 3/00
USPC ..... 42/70.01, 70.05, 70.06, 70.09
See application file for complete search history.

(56) References Cited

U.S. PATENT DOCUMENTS

| | | | | |
|---|---|---|---|---|
| 4,203,348 | A * | 5/1980 | Sokolovsky | F41A 17/38 42/70.04 |
| 5,088,222 | A * | 2/1992 | Larson | F41A 17/56 42/70.04 |
| 5,303,494 | A * | 4/1994 | Tuma | F41A 17/56 42/69.03 |
| 5,386,659 | A * | 2/1995 | Vaid | F41A 19/32 42/69.02 |
| 5,388,362 | A * | 2/1995 | Melcher | F41A 17/36 42/70.02 |
| 7,180,425 | B2 * | 2/2007 | Yuasa | G01P 1/127 340/669 |
| 7,810,268 | B1 * | 10/2010 | McGarry | F41A 11/00 42/69.01 |
| 2002/0020100 | A1 * | 2/2002 | Roca | F41A 9/45 42/70.11 |
| 2006/0150466 | A1 * | 7/2006 | Hochstrate | F41A 17/72 42/69.03 |
| 2006/0191182 | A1 * | 8/2006 | Curry | F41A 17/02 42/70.04 |
| 2009/0007476 | A1 * | 1/2009 | Mauch | F41A 17/063 42/1.01 |

(Continued)

*Primary Examiner* — Samir Abdosh
(74) *Attorney, Agent, or Firm* — Finch & Maloney PLLC

(57) ABSTRACT

A pistol has a frame with a striker operably connected to the frame. A trigger is operably connected to the frame. A transmission element is operably connected between the trigger and striker to motivate the striker to discharge the firearm in response to actuation of the trigger. The transmission element is movable between a first position in which operation connection from the trigger to the striker is enabled, and a second position in which operation connection from the trigger to the striker is disabled in response to acceleration forces due to dropping the pistol.

12 Claims, 16 Drawing Sheets

(56) References Cited

U.S. PATENT DOCUMENTS

| | | | | |
|---|---|---|---|---|
| 2016/0202009 | A1* | 7/2016 | Olivas, Jr. | F41A 17/22<br>42/70.06 |
| 2017/0003093 | A1* | 1/2017 | Spinner | F41A 17/64 |
| 2017/0321982 | A1* | 11/2017 | Gray | F41A 19/31 |

* cited by examiner

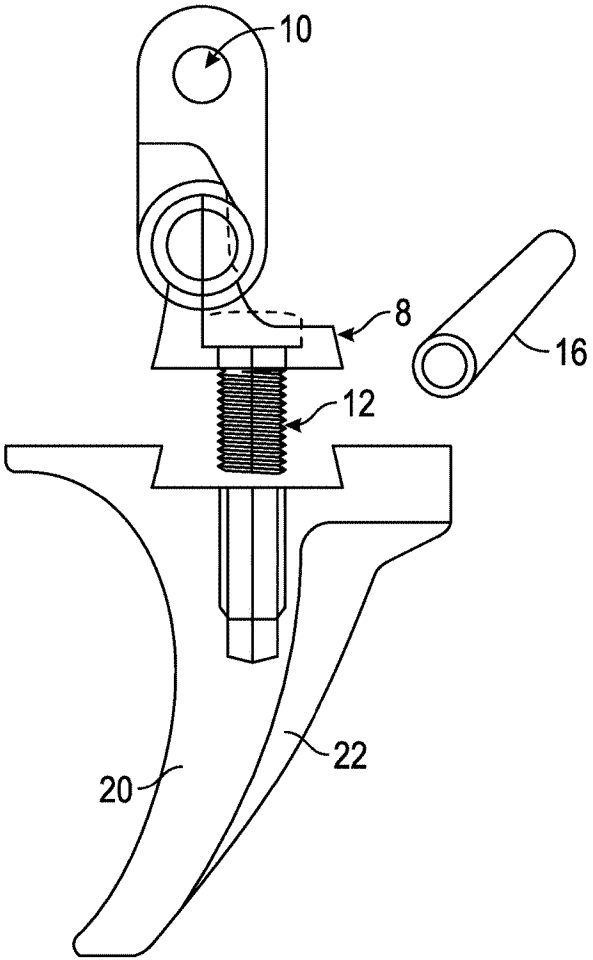
FIG. 22
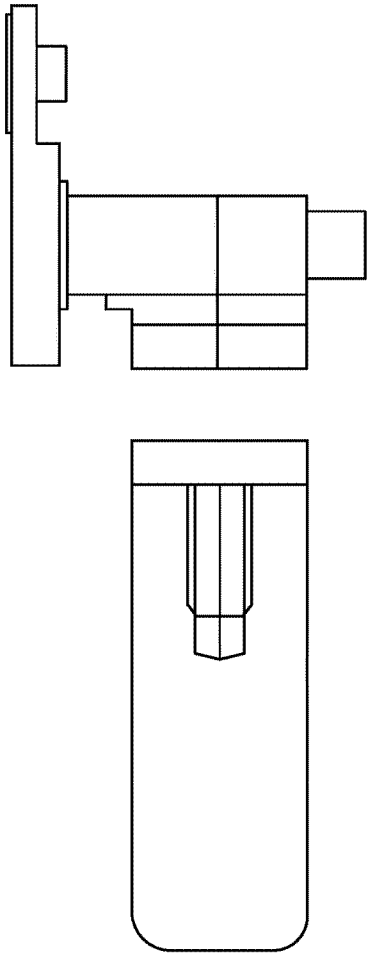

FIRE CONTROL MECHANISM FOR STRIKER-FIRED PISTOLS WITH ENHANCED SAFETY FEATURES

CROSS-REFERENCE TO RELATED APPLICATION

This application claims the benefit of U.S. Provisional Patent Application No. 62/279,706 filed on Jan. 16, 2016, entitled "Fire Control Mechanism for Striker-Fired Pistols with Enhanced Safety Features," which is hereby incorporated by reference in its entirety for all that is taught and disclosed therein.

BACKGROUND AND SUMMARY

The present invention relates to the improvement of trigger pull characteristics and mechanical safety of certain striker fired pistols which incorporate a pivoting sear to hold back the striker, and which is actuated by a trigger bar.

Certain striker-fired pistols such as the SIG SAUER® P320 incorporate a pivoting sear in the frame or receiver. This sear is spring loaded to interpose the sear face before the striker, thus holding it back in a cocked position against the substantial tension of the striker spring and positive engagement angles, unless and until the sear is rotated to free the striker and permit it to travel forward as it normally would to fire a primed cartridge.

The sear must present adequate engagement to the striker, and be sufficiently sprung, as to provide an objective measure of mechanical resistance to releasing the striker if the pistol is dropped or jarred. Certain pistol designs are dependent upon positively angled sear engagement surfaces and substantial sear spring tension to hold the striker and sear in engagement with an acceptable margin of mechanical safety.

During the normal sequence of operation, actuation of the sear to discharge the pistol is effected by the action of a trigger bar which transmits pressure and movement of the trigger to a leverage point on the sear. Pressure applied to the trigger must overcome the resistance of the sear engagement and springs to rotate the sear, defeat the striker safety lock mechanism, release the striker, and thus discharge the pistol. That sear engagement and springing have a direct effect upon both measurable and subjective trigger pull weight and feel, and therefore certain service pistols like the P320 are designed with relatively heavy trigger pulls measuring well above 6 pounds.

Competitive marksmen and other discerning or elite pistol users often prefer lighter trigger pulls with less perceived movement of the sear engagement and a more cleanly defined sear release feel as a demonstrable aid to precision marksmanship. Conventional methods of achieving a more preferable trigger pull typically involve reduced sear engagements, altered sear angles and reduced sear and striker springs to thus reduce both measurable and perceived trigger pull weight, and enhance subjective feel. Such methods typically compromise the original design's margin of mechanical safety against accidental mishandling or extreme use, if not eliminating that margin altogether. More sophisticated methods for achieving improved trigger qualities are typically not cross and reverse compatible within the applicable model line and involve custom tuning, limiting the practical utility of same as drop-in kits or for mass production as a factory-installed system.

This invention comprises a set of fire control components which may be configured to reduce trigger pull weight, enhance the subjective feel of the trigger pull, and improve the shooting qualities of the applicable pistol, while providing simple mechanisms to improve the system's mechanical reliability and safety values related to resistance to unintentional discharge from being dropped, jarred or otherwise mishandled.

BRIEF DESCRIPTION OF THE DRAWINGS

FIG. 22 is a schematic view of a preferred embodiment of the invention.

DETAILED DESCRIPTION OF THE PREFERRED EMBODIMENT

Figure 1:
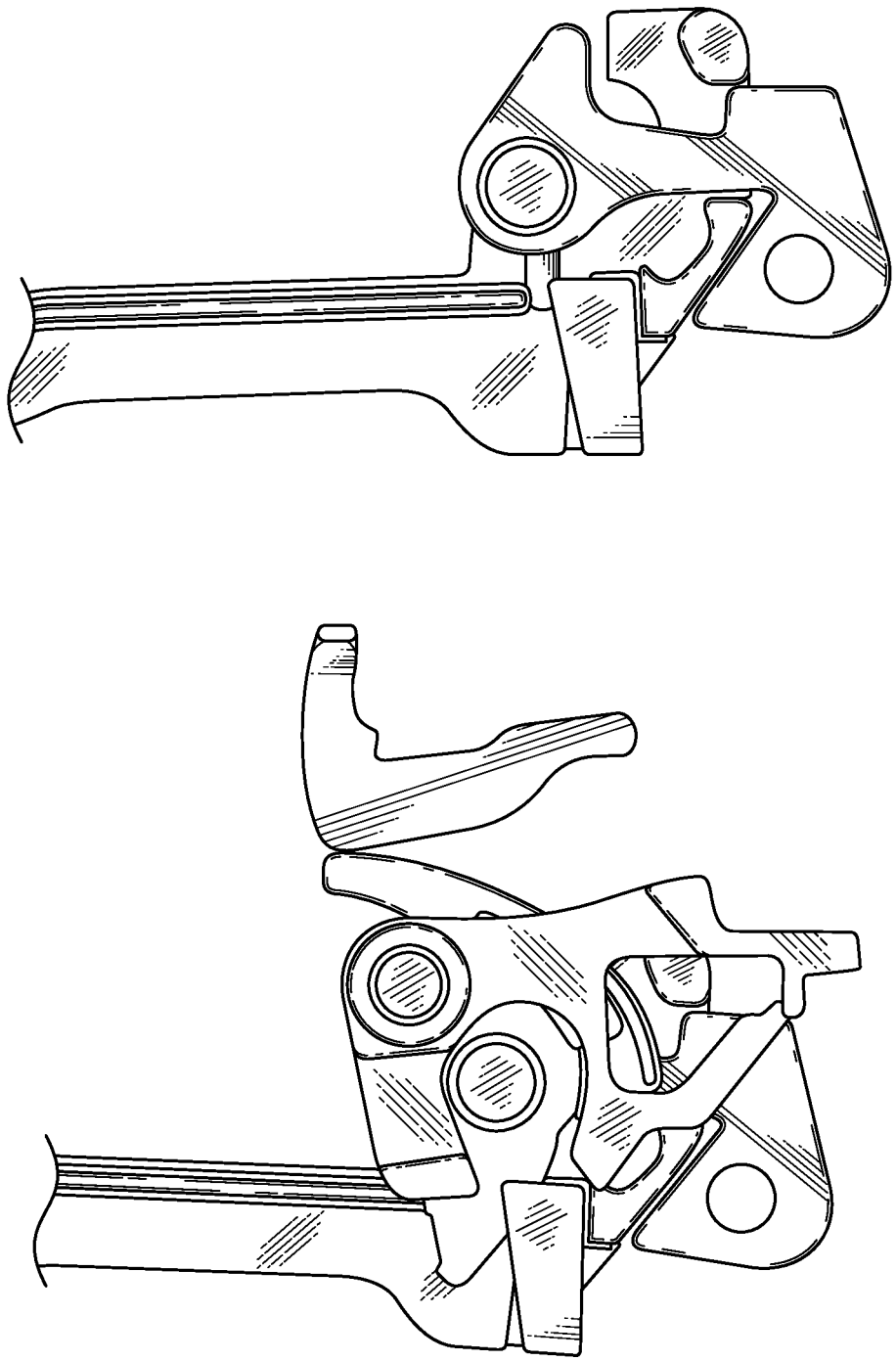
FIG. 1 is a side view of the invention according to a preferred embodiment.
Figure 2:
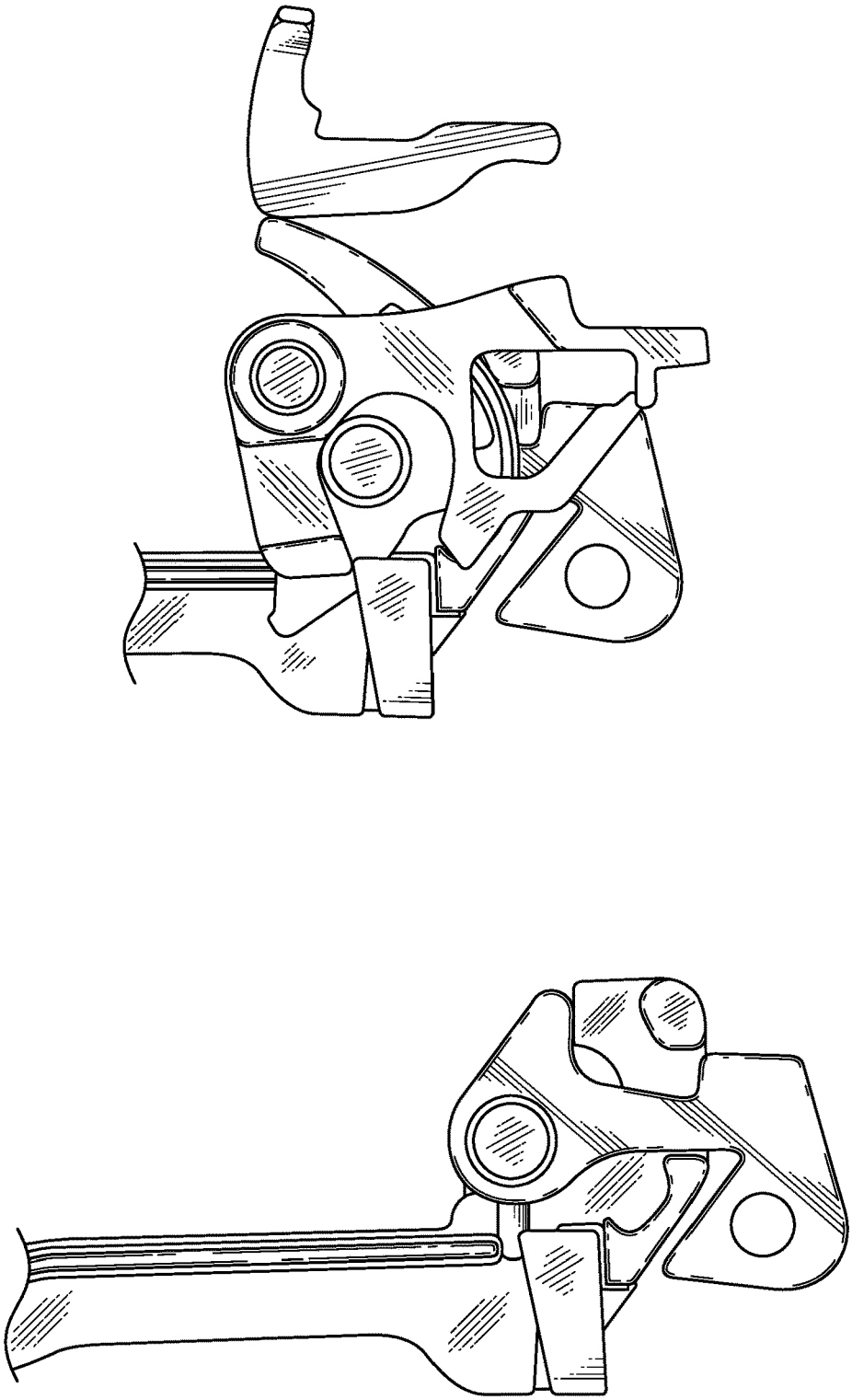
FIG. 2 is a side view of the invention according to a preferred embodiment.

This invention is a fire control mechanism for the SIG SAUER® P320 with operating principles applicable to other pistol models, comprised of the following components:

A) Sear, with enhanced sear face geometry and reset timing, and novel drop-safety-cam features. (FIGS. 1, 2).

Figure 3:
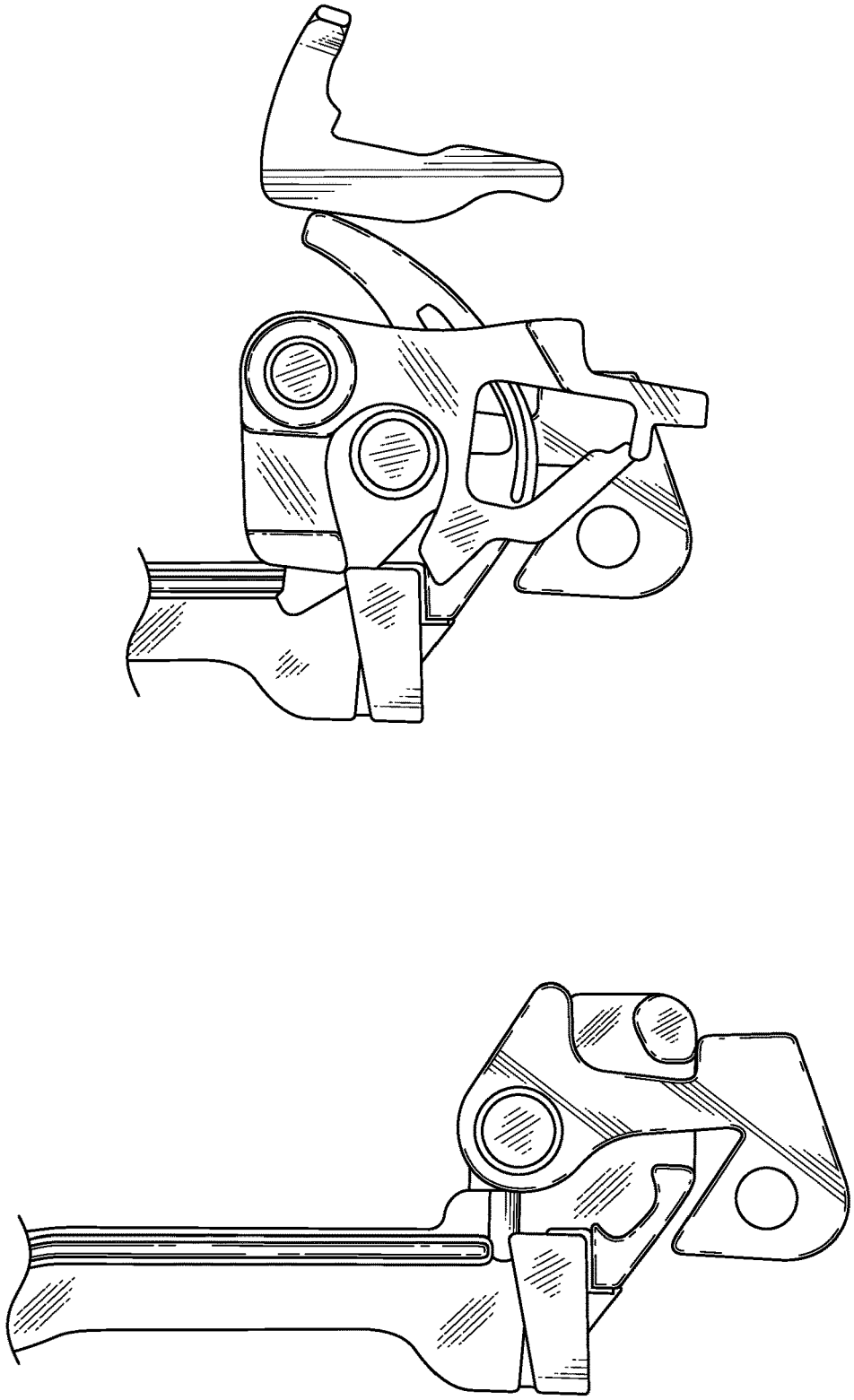
FIG. 3 is a side view of the invention according to a preferred embodiment of the invention.
Figure 4:
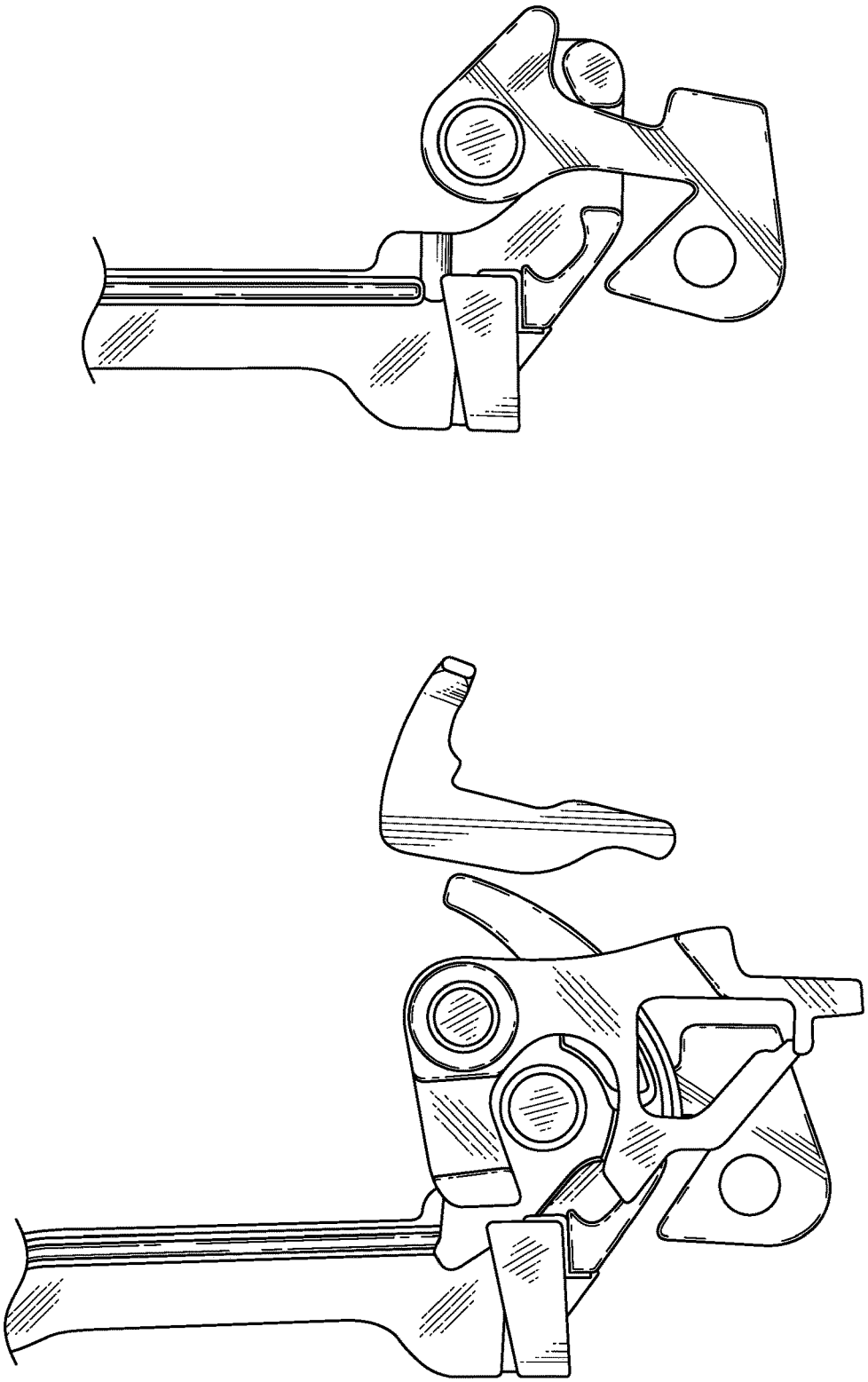
FIG. 4 is a side view of the invention according to a preferred embodiment of the invention.

B) Trigger, with features to enhance trigger bar leverage, and interchangeable trigger shoes. (FIGS. 3, 4).

Figure 5:
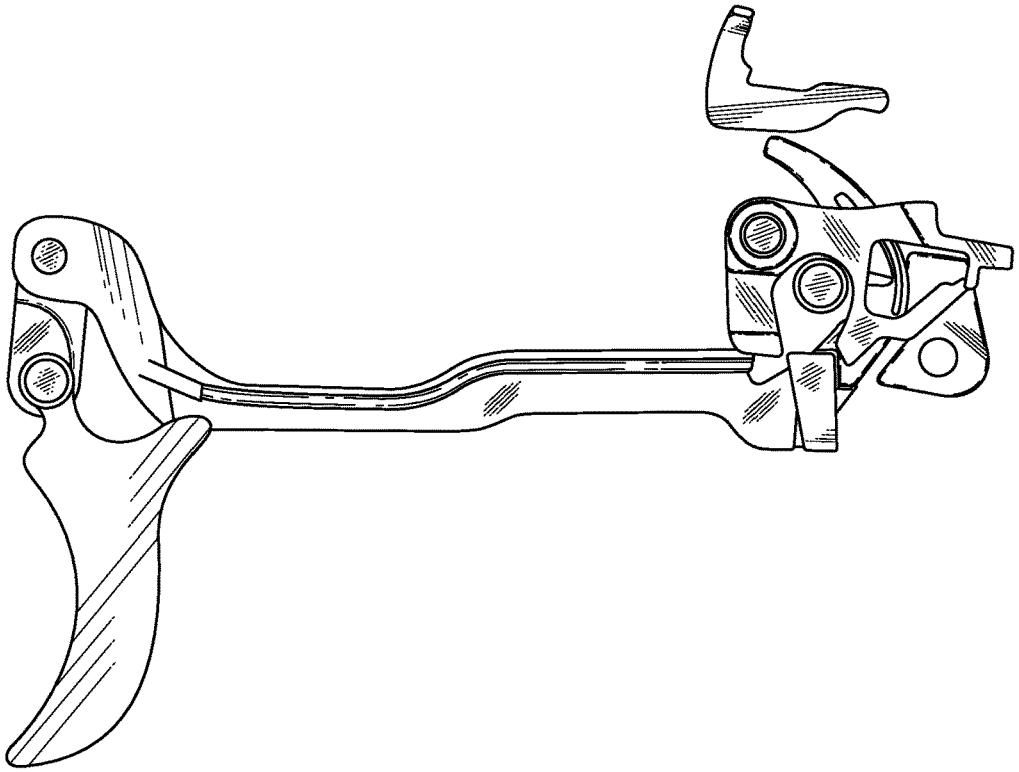
FIG. 5 is a side view of a preferred embodiment of the invention.

C) Trigger bar control cam plate, novel design which controls the movement of the trigger bar to keep it in engagement with the sear safety cam (FIG. 5).

Figure 6:
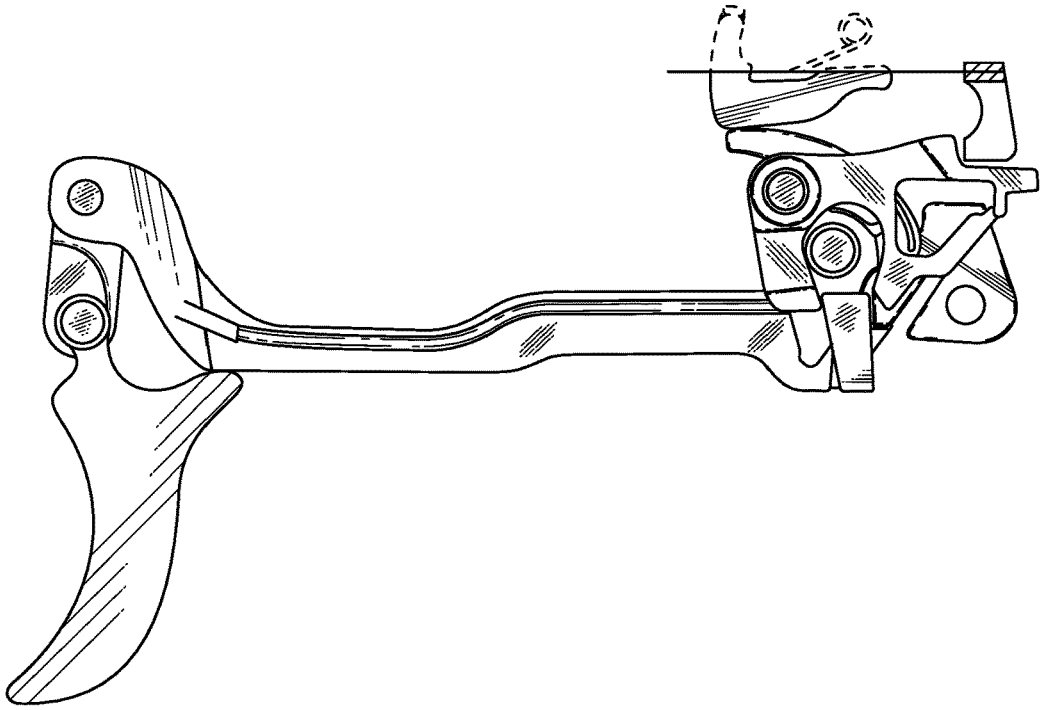
FIG. 6 is a side schematic view of a preferred embodiment of the invention.

D) Disconnector, novel design which controls the movement of the trigger bar, provides trigger bar disconnect function, and thus provides for shorter net trigger reset travel as a reverse-compatible alternate embodiment within the invention system (FIG. 6).

Figure 7:
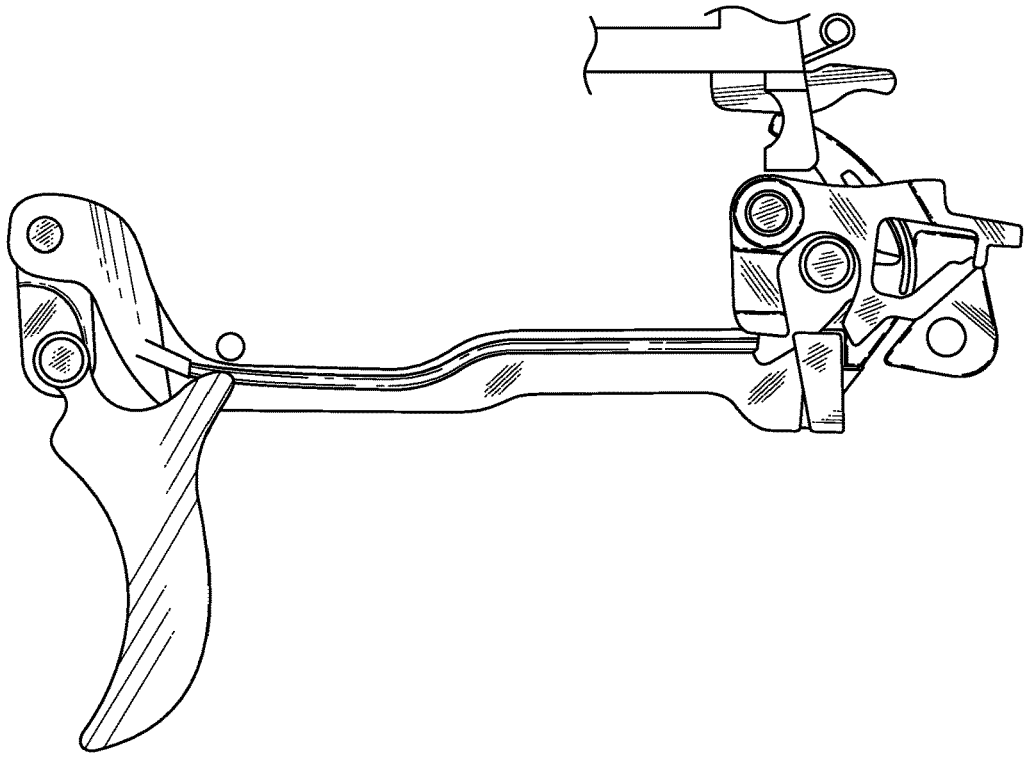
FIG. 7 is a side schematic view of a preferred embodiment of the invention.
Figure 8:
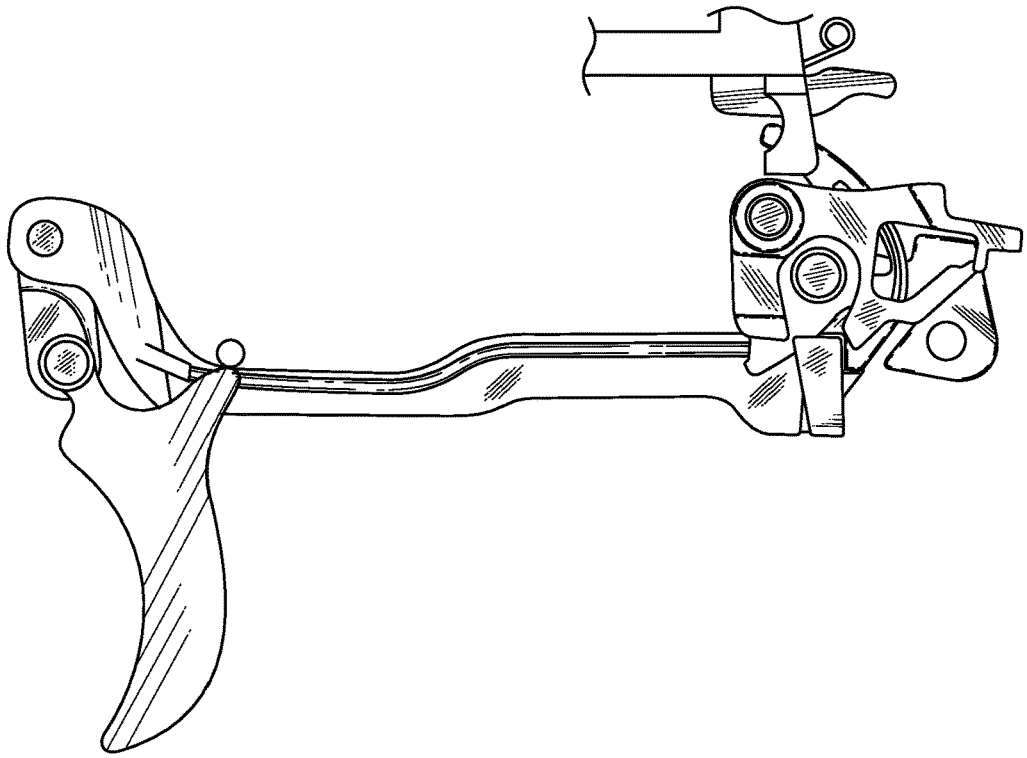
FIG. 8 is a side schematic view of a preferred embodiment of the invention.
Figure 9:
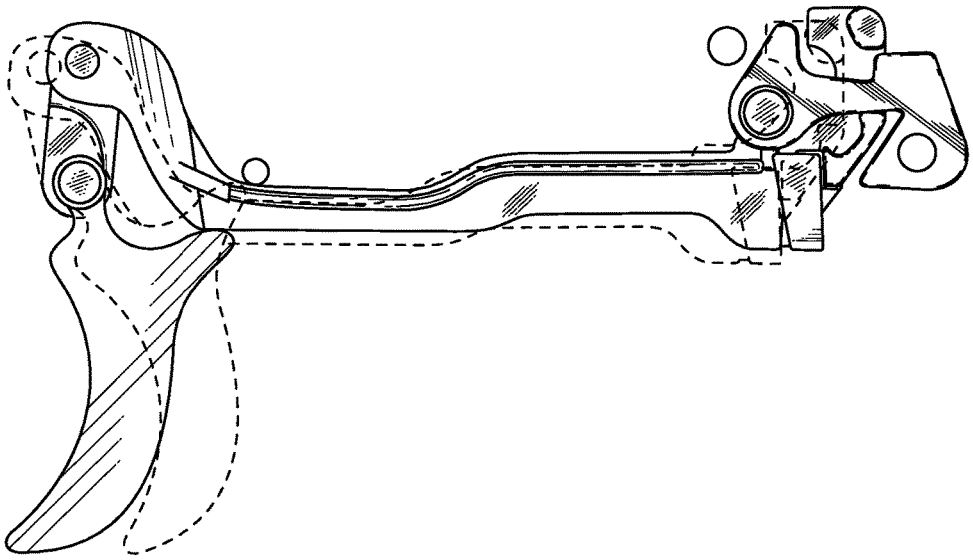
FIG. 9 is a side schematic view of a preferred embodiment of the invention.
Figure 10:
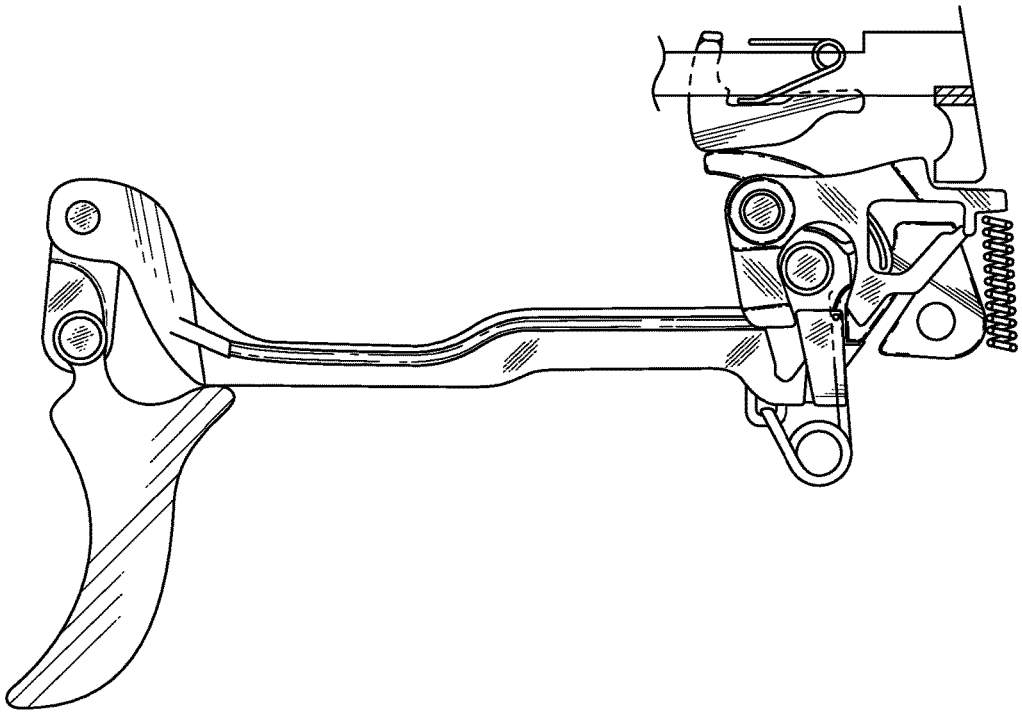
FIG. 10 is a side schematic view of a preferred embodiment of the invention.
Figure 11:
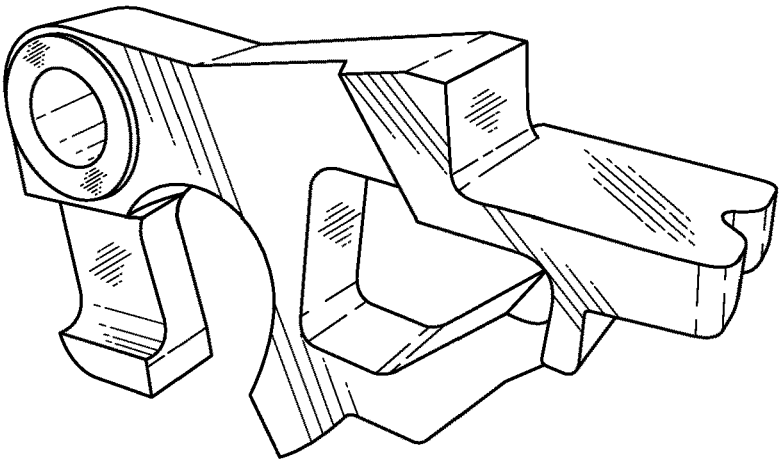
FIG. 11 is a left side isometric view of a preferred embodiment of the invention.
Figure 12:
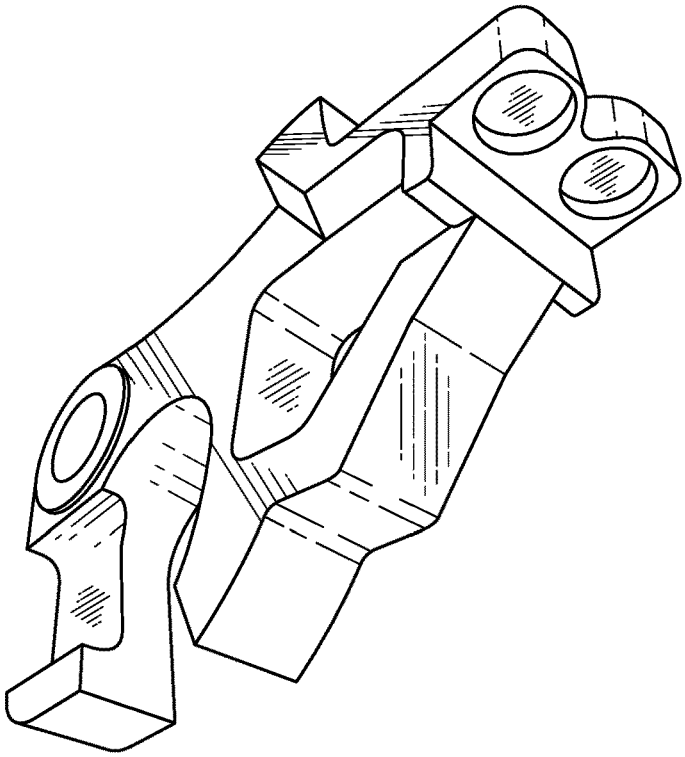
FIG. 12 is a bottom left side isometric view of a preferred embodiment of the invention.
Figure 13:
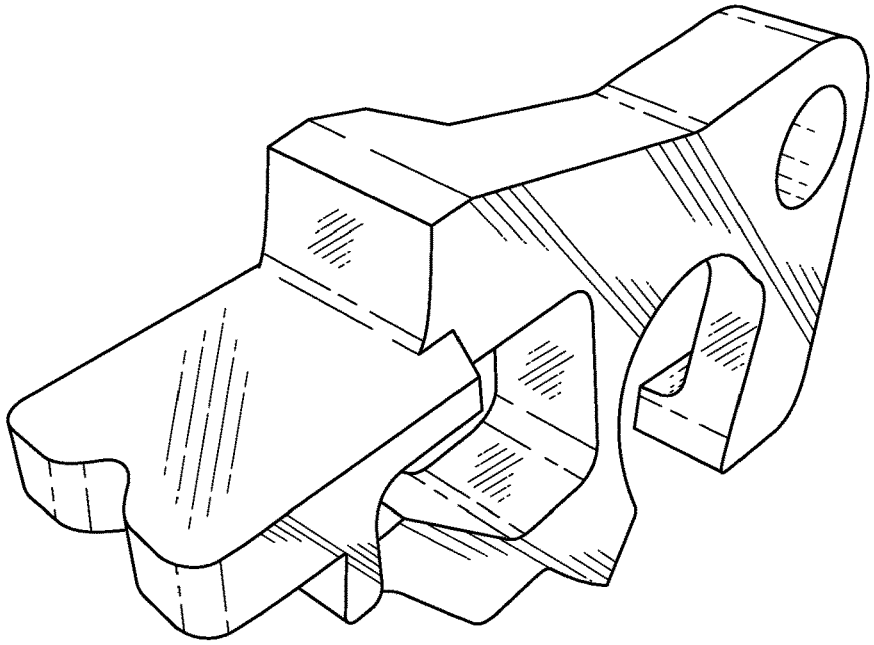
FIG. 13 is a right side isometric view of a preferred embodiment of the invention.
Figure 14:
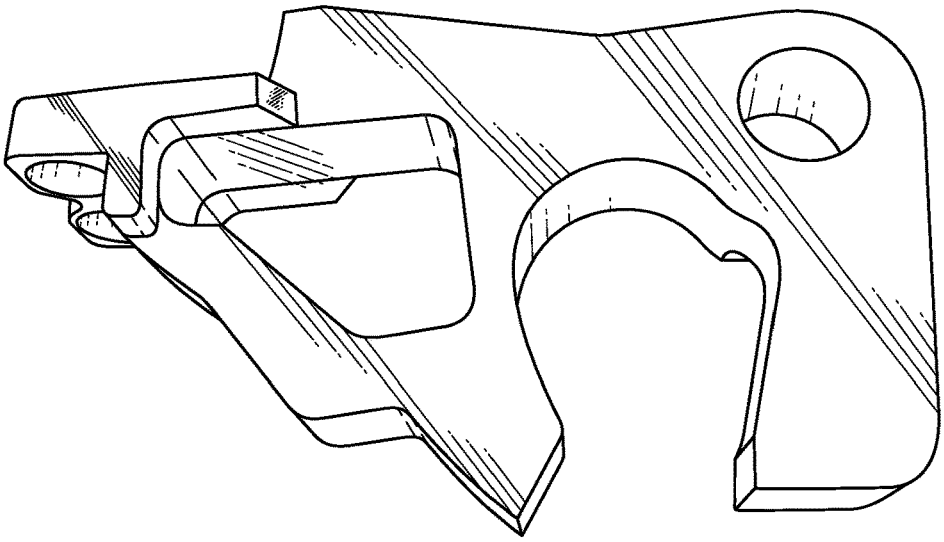
FIG. 14 is a bottom right side isometric view of a preferred embodiment of the invention.
Figure 15:
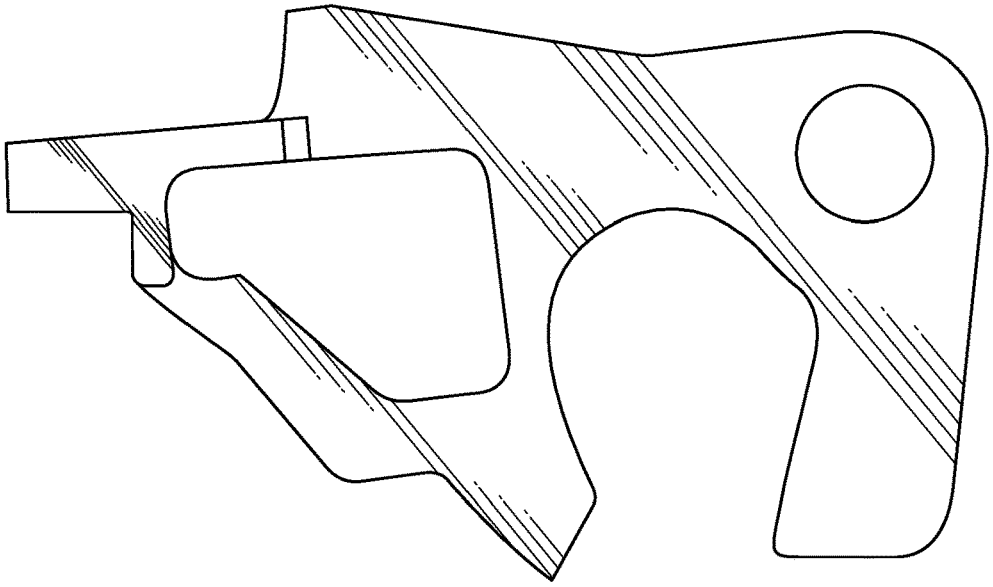
FIG. 15 is a right side isometric view of a preferred embodiment of the invention.
Figure 16:
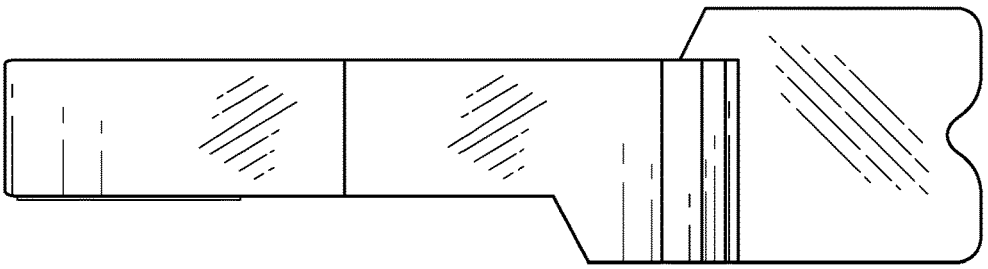
FIG. 16 is a top isometric view of a preferred embodiment of the invention.
Figure 17:
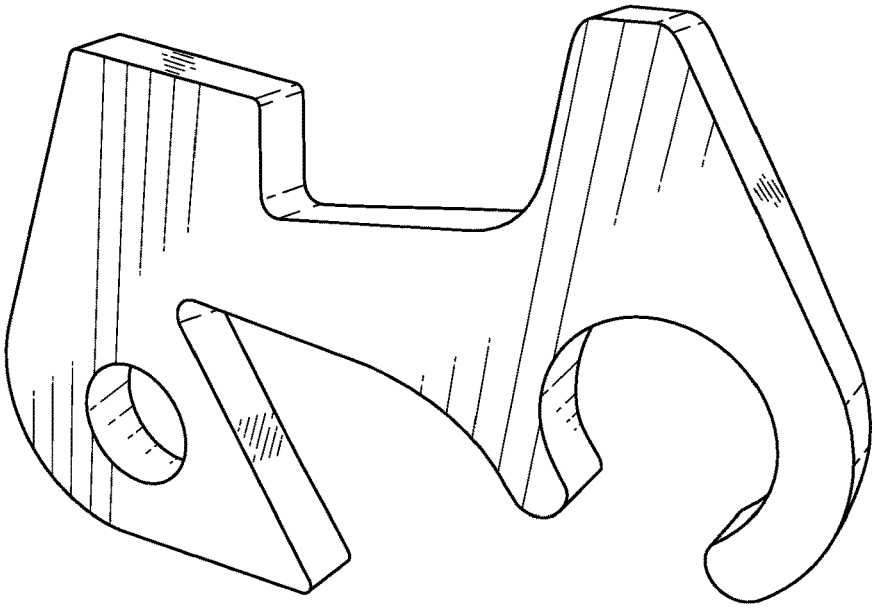
FIG. 17 is a side isometric view of a preferred embodiment of the invention.
Figure 18:
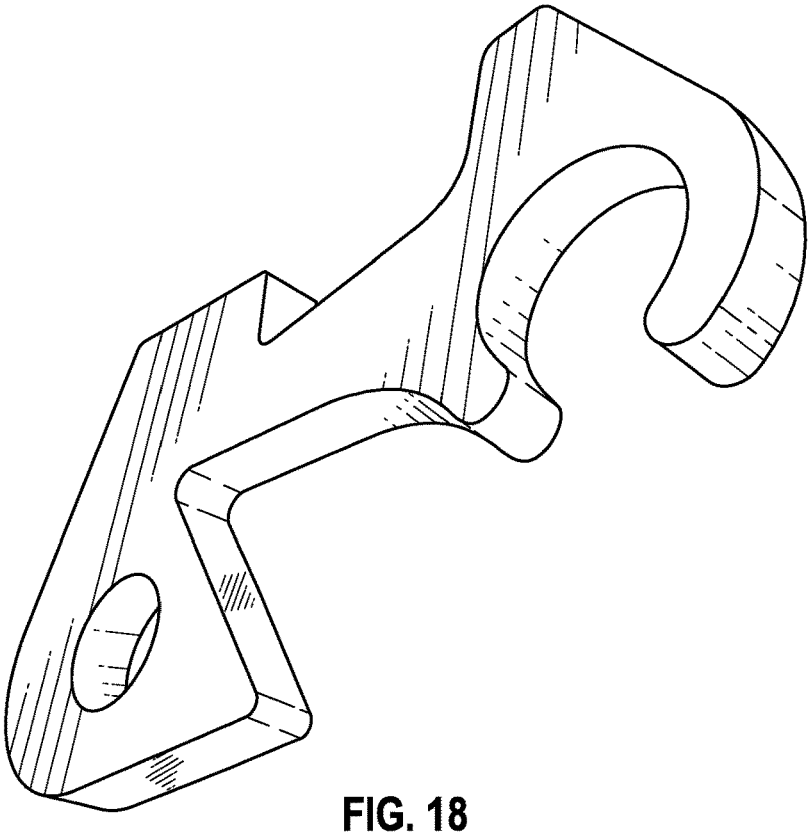
FIG. 18 is an isometric bottom view of a preferred embodiment of the invention.
Figure 19:
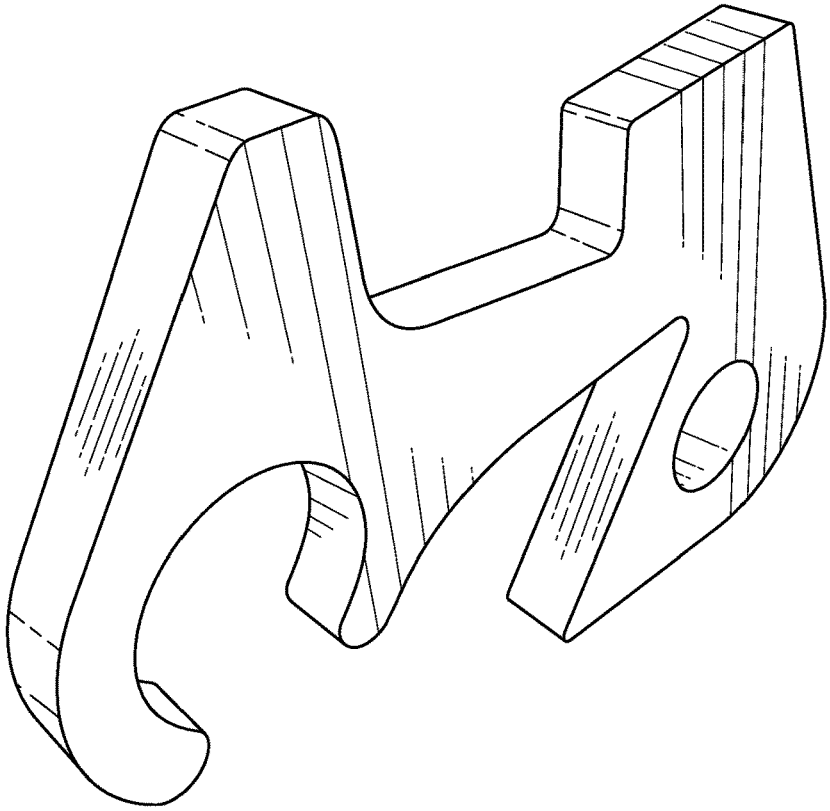
FIG. 19 is an isometric view of a preferred embodiment of the invention.
Figure 20:
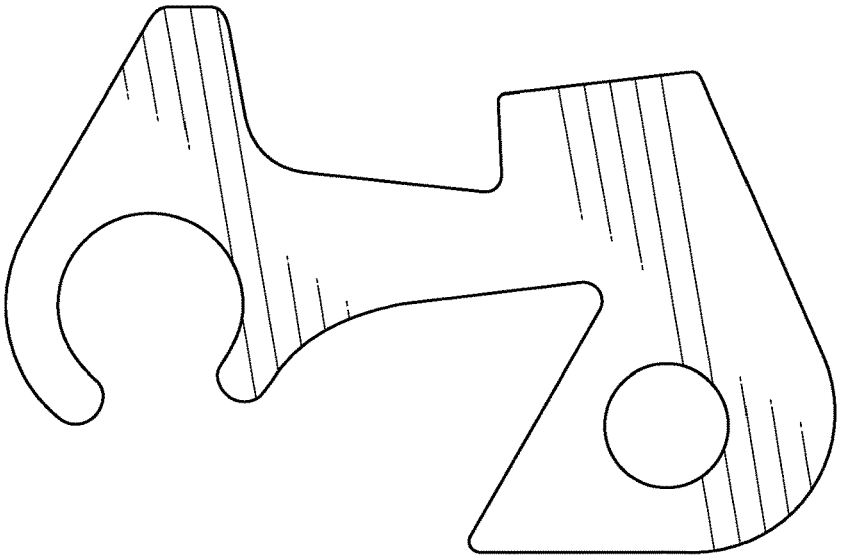
FIG. 20 is a side isometric view of a preferred embodiment of the invention.
Figure 21:
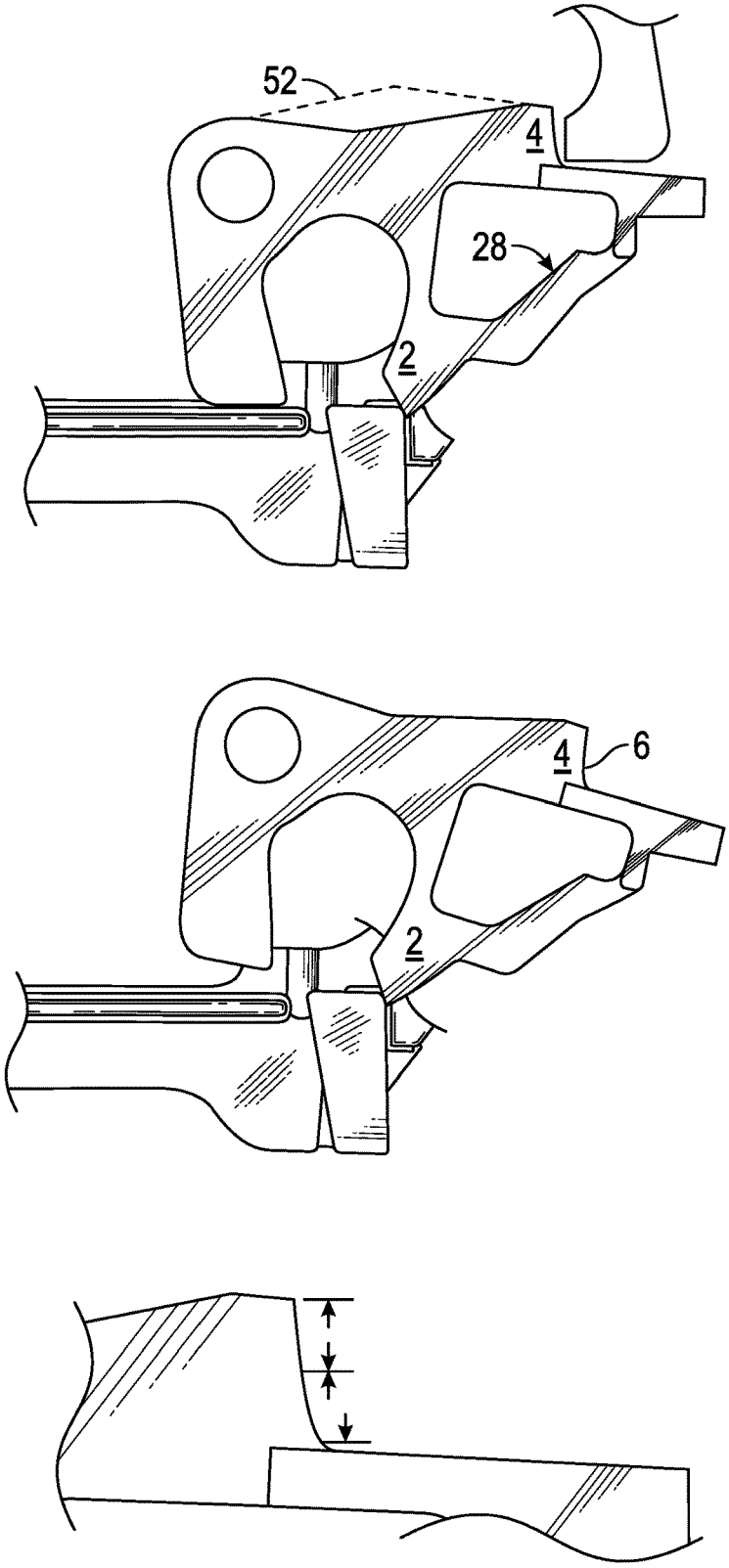
FIG. 21 is a schematic view of a preferred embodiment of the invention.
Figure 23:
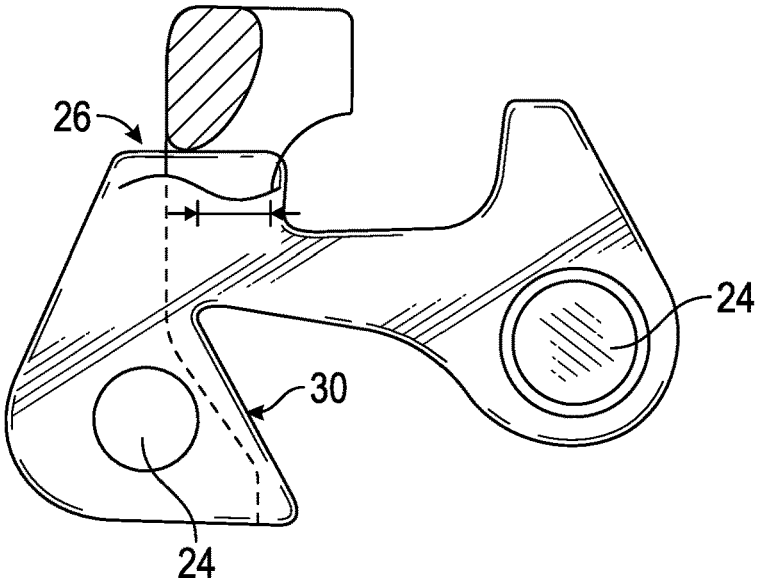
FIG. 23 is a schematic view of a preferred embodiment of the invention.
Figure 24:
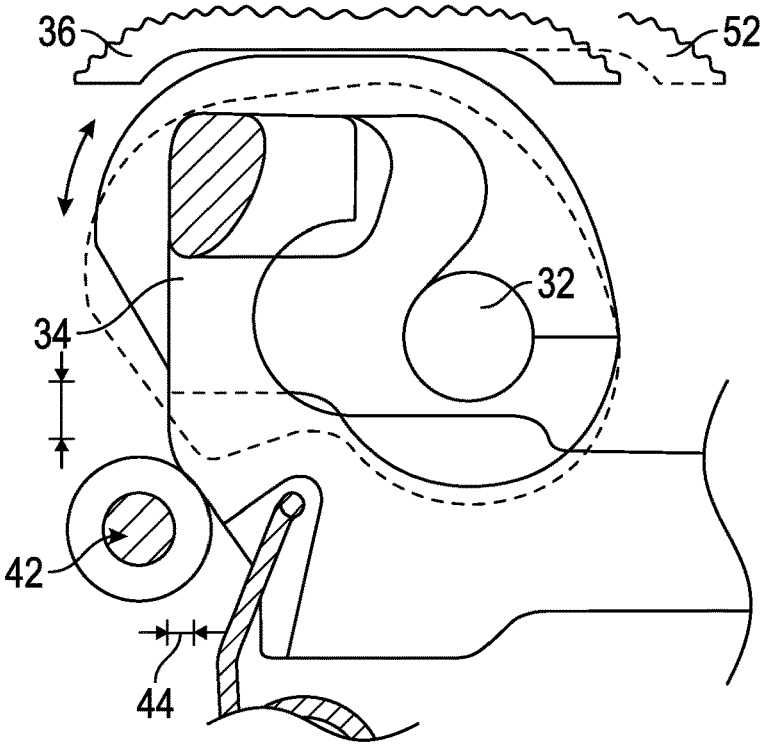
FIG. 24 is a schematic view of a preferred embodiment of the invention.
Figure 25:
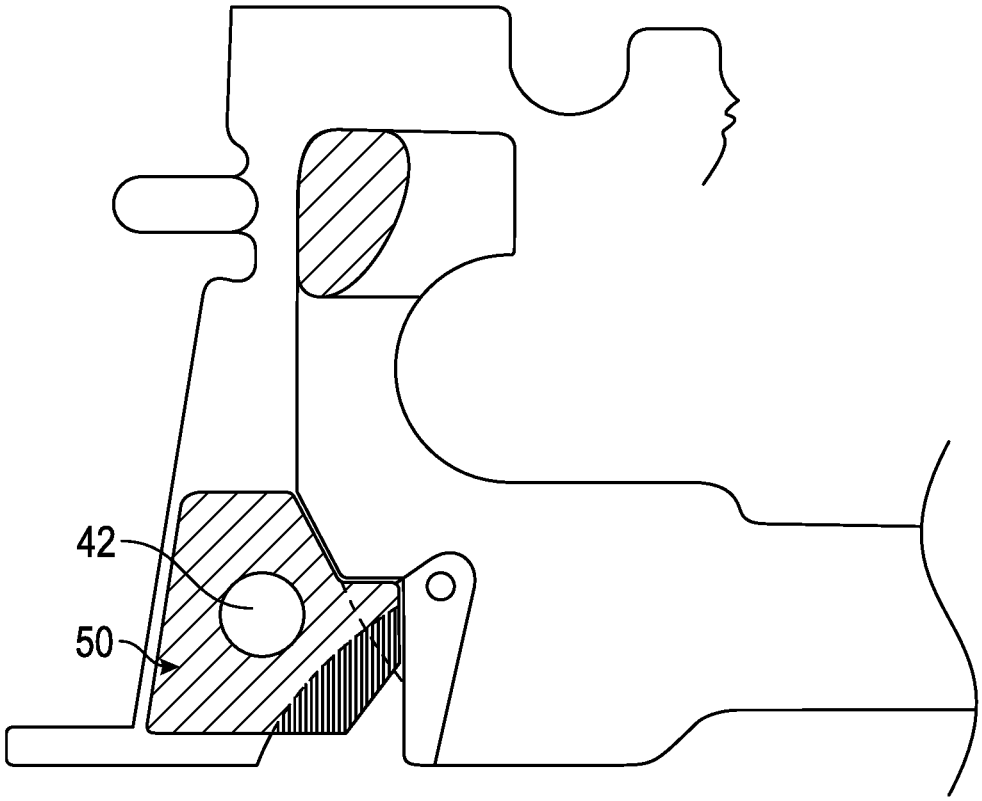
FIG. 25 is a schematic view of a preferred embodiment of the invention.

E) Limit ring and sear housing pin assembly, which limits trigger pretravel, controls the vertical movement of the trigger bar in it's at-rest position, prevents disassembly of the trigger and bar without tools. Plus, an alternate design. (FIG. 7)

F) Over travel stop pin tube; used with the disconnector option to time and reduce trigger overtravel after striker release.

G) Safety lever and sear pins, designed to properly locate and retain components of the invention.

H) Sear and trigger bar springs, designed to be installed in various specific combinations to yield predictable trigger pull weights within a predetermined range.

Sear. The safety-cam sear is at the heart of the invention. Its design features provide the essential functional qualities and attributes which yield superior trigger pull characteristics and reduced pull weight, while enhancing reliability and mechanical safety values necessary for the safe use of the pistol. It is made from tool steel, optimally heat treated to resist wear and failure, polished and treated to provide a low coefficient of friction. Its elements include:

Safety-cam device (element 2), which connects the sear to the trigger bar and thus transmits trigger bar spring tension directly to the sear. This tension augments the upload exerted upon the sear by the sear spring(s), thus increasing the load required to rotate the sear down out of its resting position of engagement with the striker when cocked and the trigger is forward, as would be the condition of the fire control mechanism if the pistol were to be dropped whilst cocked. Downward rotation of the sear, as required to release the striker, is impeded by the relatively poor leverage this cam surface applies to the trigger bar, which is driven forward and down against substantial spring tension as the sear rotates out of engagement. The cam is shaped to drive the trigger bar down and forward at an optimum angle in relation to the vertical axis of the receiver, thus preventing it from rotating the safety lever upwards, and preventing it from defeating the striker safety lock. In a modified sear housing, this cam can have substantially greater engagement with the trigger bar, but is not necessary for function as claimed.

Maximum-engagement sear face (element 4). This sear profile features significantly increased total sear engagement over the original factory sear. This increased standing sear face engagement accomplishes several important functions. It compensates for the considerable vertical clearance between the P320 slide and frame, and between the striker housing and slide assembly, each of which introduces an inconsistent gun-to-gun variable in net sear to striker engagement, thus preserving safely adequate engagement in worn and out of spec pistols. This increased engagement requires a correspondingly greater arc of rotation for the sear to release the striker, and a correspondingly greater dislocation of the trigger bar under tension, thus enhancing the drop-safe benefit provided by the cam-safety device.

This increased engagement is more resistant to any tendency for the striker to push it out of the way as it hits the sear when the action closes into battery during normal operation of the pistol's action. The longer arc of rotation required for the sear to release the striker assists in the proper timing of trigger bar release and reset, placing the striker release and trigger bar release points closer together relative to trigger travel, thus opening the critical tolerances for the sear to trigger bar relationship to a consistently attainable dimension for production.

Sear face with leverage change (element 6). When fully rotated up into full engagement, this sear face profile presents the contacting surface of the striker with a virtually neutral angle relative to its pivot point. Thus, unlike the stock sear, this sear does not significantly cam the striker back against its spring tension as it begins its downward rotation. This greatly reduces the weight of this initial sear travel; as she presses the trigger to the rear to release a shot, the operator perceives this initial sear travel as blending innocuously into trigger pre-travel, rather than as disagreeable "creep" normally associated with increased sear engagements. This initial neutral engagement is engineered to positively reset to full engagement under sear spring tension if the trigger is partially pressed and released.

As the operator continues to press the trigger through this initial pre-travel and neutral engagement, the sear face presents the striker engagement with an increasing rate of angle change relative to the sear pivot axis. In the approximate final third of its engagement, the striker spring begins to load the sear as the striker is cammed back slightly. This leverage change is timed to coincide with the increased resistance felt through the trigger by the disconnect cam function of the trigger bar, and can be calibrated to yield more or less total breaking trigger pull weight. This provides the operator with a defined pressure wall at the end of perceived pre-travel or trigger take-up, and a sensation of a relatively crisp striker release, or trigger break, that is more consistent with an action featuring significantly less safe sear engagement values.

This increased sear engagement, by its greater standing height before the striker being more tolerant of unintended striker release or bypass malfunctions due to jarring or violent slide cycling, can thus permit of reduced sear spring tension whilst preserving an adequate measure of mechanical safety. Reduced sear spring tension obviously reduces the trigger force required to rotate the sear. It also has the effect of making the self-disconnecting and reset function of the trigger bar and sear relationship more positive and certain at significantly lighter trigger pulls.

B) Modular trigger assembly. The trigger is connected via it's axle to the receiver, and to the trigger bar via the drive stud. It functions conventionally by rotating on its axis in the receiver, which motion draws the trigger bar forward to actuate the safety lever, defeat the striker safety lock, and make contact with the lower leg of the sear, rotating the sear down and out of engagement with the striker to fire the pistol. This assembly consists of three pieces and one accessory: the top section with axle, shoe mounting dovetail (element 8), and drive stud (element 10); the shoe retaining screw (element 12); the trigger shoe (element 14); and the over travel stop pin tube (element 16).

The top section has a number of important features. The axle is machined or formed to maximum dimensions to fit the P320 receiver to reduce lost motion during trigger manipulation. The drive stud location is engineered to exert maximum leverage against the trigger bar, consistent with proper fit within the grip module and disconnect function. This yields a significant reduction in trigger pull weight at no compensatory cost to sear springing, mechanical safety, or engagement values. The axle incorporates a groove at its rear right to provide clearance for the trigger bar. The shoe mounting dovetail, interchangeable trigger shoes, and drive stud are positioned to provide the optimal over travel stop location for the original self-disconnecting function of the P320, as well as for the alternative slide-actuated disconnector embodiment when used with the accessory over travel stop tube.

The interchangeable trigger shoe is retained to the trigger top section by a transverse dovetail and a simple screw. The interchangeable feature provides modularity (element 20) to permit adjustment of trigger reach, shape and texture to suit the operator's personal preferences. The accompanying drawing is generically representative of the myriad of possible shapes. To compensate for the increased cranking leverage the trigger bar drive stud location yields while maintaining drop-safety integrity, the trigger shoes are made from a lighter material than the stock factory triggers (element 22).

C) Bar control cam plate. This plate is made from tool steel, hardened and treated for maximum wear resistance and low friction. It mounts to the rear right side of the receiver via an elongated sear housing pin and safety lever pin (element 24). It serves several important functions. First, the top rear contour of the plate forms a shelf (element 26) upon which the topmost bearing of the trigger bar rests when the trigger is in its forward at-rest position. This shelf prevents the trigger bar from dropping straight down on the vertical axis of the receiver, thus keeping it up in contact with the sear safety cam feature unless and until the trigger bar is first drawn forward some distance. This shelf is sufficient to prevent the trigger bar from falling straight down out of engagement with the sear of its own inertia if the pistol is dropped from a reasonable height or comparably jarred, thus holding the much less massive sear in place and enhancing drop-safety integrity under circumstances most likely to result in sear-hold failure.

This shelf provides significant resistance to the sear's downward rotation, since the safety cam must exert substantial force through poor leverage to push the trigger bar forward off the shelf first, before the bar can drop. The bar control cam plate is shaped to permit the trigger bar to move forward and down under load from the sear safety cam, but limits this movement to prevent the trigger bar from escaping it's track on the sear housing and becoming dislodged out of position. The trigger bar and trigger thus cannot be dismounted from the receiver without the use of a simple tool, I.E. a pin punch. A clip could be added to the opposite side of the safety lever pin that also holds the bar cam plate in position to further dissuade unauthorized or inadvertent disassembly of the fire control unit. In this way, the bar cam plate enhances reliability and serviceability with the net addition of only one new part.

The bar cam plate and sear safety cam feature work together to drive the trigger bar forward and down at an angle which prevents the bar from engaging the safety lever and rotating it sufficiently to defeat the striker safety lock in the slide. In this way, the mechanism further enhances the safety of the arm. The plate is shaped to accommodate the sear's extreme maximum downward rotation to permit full function of the takedown safety lever during field stripping. Additionally, the sear itself has been designed to improve the leverage which the takedown safety lever can exert against it to rotate it down out of engagement with the striker (Element 28). Additionally, the bar control cam plate has a feature which permits precise pretravel adjustment (element 30). It should be noted that significant pretravel reduction would require a change to the safety lever timing, which we have developed as a further optional embodiment of the invention.

D, E, F) Disconnector, limit ring and sear housing pin assembly, and trigger over travel stop pin tube suite. This suite of novel components are designed to function together as an alternative trigger enhancement embodiment incorporating the core functional attributes of the invention, expressed in a different manner.

The disconnector is made from tool steel, hardened and treated to withstand wear and shock, and to provide a low coefficient of friction. It fits against the rear right side of the receiver. It pivots from its front (muzzle) end on an extended safety lever pin (element 32), and engages the trigger bar in the slot formed between bearing surfaces at its rear end (element 34). It is actuated by the camming action of a corresponding cam cut in bottom of the right rear slide rail (element 36). On the current standard P320, this cut would be approximately 0.027" deep, and extend the approximate length of the disconnector with its forward (muzzle) end tailing out to provide a specific amount of rear slide travel before engagement (element 38). The depth of this cut would be adjusted to suit different slide rail groove thickness, to best exploit the leverage ratio available to this design. The ratio of net trigger bar drop to slide cam cut is approximately 1.8:1, sufficient to positively disconnect the trigger bar from the sear in a P320 pistol exhibiting substantial slide to frame fit clearance.

The disconnector eliminates the need for the self-disconnecting trigger bar mechanism of the original P320 design. Thus, the excess trigger over travel after striker release required to function that self-disconnecting mechanism can be eliminated. This over travel reduction is easily accomplished by installing the over travel stop pin tube over the stop pin, increasing its diameter and halting the trigger's rearward rotation in time to striker release, but prior to auto-disconnect function. This tube is made from hardened steel.

The limit ring and sear housing pin assembly is a steel cylinder of sufficient diameter to block rearward travel of the trigger bar, and sufficiently long to locate laterally within the grip module, bored through with a 2.5 mm hole to accept an extended rolled spring pin. This pin is affixed to the cylinder to prevent it from drifting out (element 42). It is installed from the right in place of the factory P320 sear housing pin and thus does not increase the net parts count of the pistol.

This assembly performs at least three important functions. First, the limit ring bears against the lower rear angled corner of the trigger bar when it is at rest; this angled contact laps the ring by approximately 0.020", which helps keep the bar in contact with the sear if jarred and offers some resistance to the camming action of the sear against the trigger bar (element 44). Second, the diameter of the limit ring can be calibrated to provide a precise reduction in trigger pretravel, much as the bar cam plate can be (element 46). Third, the assembly can be easily adapted to prevent full dismounting of the trigger bar and trigger without the use of tools. It's installation and function does not require modification to the pistol.

An alternative design to the limit ring assembly utilizes a shaped cam that is indexed to the receiver through a locating tab, and a modified trigger bar that engages at a shallower angle to enhance its resistance to vertical displacement (element 48, Fig.). This alternative design yields drop safety performance comparable to the first system described herein utilizing the bar cam plate.

G,) Special sear and safety lever pins. The trigger bar cam plate requires two specialized pins to locate and retain it to the receiver. The rear pin replaces the factory sear housing pin, and is longer to assure that adequate projection is available to locate the plate. The front pin replaces the factory safety lever pin, and in its basic form is simply longer to afford location. The bar cam plate's two holes are sized to permit the plate to float on these pins slightly, to prevent cramping which could potentially bind the trigger bar.

In a more advanced form, these pins may be used as positive retainers against unauthorized or inadvertent disassembly of the fire control unit. The trigger bar cannot be dismounted from the receiver without first freeing the bar cam plate. Circlips, punched ends or other fasteners could be employed for that added feature.

The same extended safety lever pin which locates the bar cam plate also functions with the disconnector alternative system. For use with the disconnector, and alternate sear pin featuring a thin, large diameter head which is installed from the left side of the receiver and retained by the safety takedown lever is required.

H) 0028 Sear and trigger bar springs. Springs to augment or replace the factory sear and trigger bar springs, calibrated to provide predictable trigger pull weights in graduated steps for fine-tuning the fire control system for personal preferences or to meet preset production standards.

These springs include two different rate sear springs, which paired together or in combination with a factory spring, can yield trigger pull weights in a wide range between sub-4 pounds to approximately 6.5 pounds. The original factory springs tend towards a relatively progressive spring rate, and tend to exert less tension when the sear is fully rotated up at rest than when rotated down and compressed. Our alternate sear springs feature smaller diameter wire with more coils and a longer free length, for a flatter spring rate. This flatter rate spring exerts proportionally more tension at rest to provide for less net sear tension to overcome as trigger pull weight, while attenuating sear flutter and providing adequately snappy return.

0029 The trigger bar spring is reduced in wire diameter and has a slightly different bend to yield more tension to the bar in its downward movement, but maintain proportionally less tension in its lateral movement to be overcome as trigger pull weight. This helps reduce the net trigger pull weight stacking effect of the auto-disconnect function induced by the camming surface of the sear housing track and trigger bar as the trigger reaches the striker release point. Yet, this spring maintains acceptable tactile trigger reset sensation, and important feature.

Preferred Embodiment

The two main alternative expressions of this invention described herein each serve to fulfill two different practical applications, and are equally valid in their respective roles. The first system, utilizing the original factory self-disconnecting trigger bar as a function of trigger overtravel, has several advantages. First, this system is completely reverse and cross compatible with all variations of the current SIG SAUER® P320 platform. Thus, this system can be dropped in to a stock pistol, function properly to a higher standard of trigger pull quality while preserving at least comparable drop safety integrity, and then be removed and the pistol restored to stock configuration in minutes, without permanent alterations to the pistol.

Additionally, the bar cam plate feature adds significantly to the drop safety integrity of this system, permitting somewhat more critical tuning with reduced sear spring rates than may be possible with the disconnector system for comparable drop safety integrity.

The disadvantage to the first system is the relatively critical dimensional tolerancing required to effect consistent trigger bar disconnect timing in a true no-fitting, drop-in scheme. However, we've demonstrated that these parts can be made to function within the range of current, typical factory tolerances. With allowance for selective assembly in a mass-production scenario, that concern evaporates. The basic system of leverage enhancement with dimensionally consistent auto-disconnect timing has been tested exhaustively.

The second system utilizing our disconnector design and limit ring assembly offers the prospect of dramatically reduced net trigger travel, trigger reset travel, and assured reliability from the same core trigger and sear set. It may not provide the same degree of added drop safety enhancement at the extreme low end of trigger pull weight possible for this platform with our sear and trigger system, but at moderate weights it is quite effective.

A variation of the second (I.E. disconnector) system utilizing a shaped cam block pinned and indexed to the receiver in place of the sear housing pin, and which engages a corresponding cam cut in the rear lower trigger bar has been developed (element 50). This third alternate embodiment of the core invention provides a positive shelf for the trigger bar to rest upon to the same effect as in the first embodiment, significantly increasing the trigger bar's resistance to being displaced downward by it's own inertia or by action of the sear safety cam. This approach offers comparable advantages in pretravel adjustment while being compatible with the disconnector.

The mating cam surfaces between cam block and trigger bar forming this shelf are angled to permit the disconnector to overcome this resistance. This action can be enhanced by timing the depression of the sear by the striker to precede disconnector function upon manual retraction of the slide with the striker forward, as after dry-firing the pistol (element 52).

What is claimed is:

1. A pistol comprising:

a frame;

a striker operably connected to the frame;

a trigger operably connected to the frame, the trigger movable between a forward position and a rearward position;

a trigger bar operatively coupled to the trigger; and a sear operatively coupled to the trigger bar and the striker, the sear including a cam surface integral to the sear, wherein the trigger bar exerts a force on the cam surface when the trigger is in the forward position, the force on the cam surface opposing pivotal movement of the sear so as to prevent movement of the striker from a cocked position.

2. The pistol of claim 1, wherein the cam surface directly engages the trigger bar when the trigger is in the forward position.

3. The pistol of claim 1, wherein the cam surface disengages from the trigger bar during movement of the trigger from the forward position to the rearward position.

4. The pistol of claim 1, wherein the cam surface biases the trigger bar forward and down when the trigger is in the forward position.

5. The pistol of claim 1, wherein the striker moves longitudinally along a bore axis of the pistol between a cocked position and a firing position.

6. The pistol of claim 1, wherein the sear includes a curved sear face configured to engage the striker to maintain the striker in the cocked position.

7. The pistol of claim 6, wherein the curved sear face has a radius of curvature that changes along a length of the curved sear face.

8. The pistol of claim 7, wherein the radius of curvature is smaller along a lower portion adjacent a cam body.

9. The pistol of claim 8, wherein the curved sear face maintains a consistent axial position of the striker during a first portion of moving the trigger from the forward position to the rearward position.

10. The pistol of claim 1, wherein the trigger bar has a sear shelf positioned between the cam surface and a lower leg of the sear that is spaced from and located forward of the cam surface.

11. The pistol of claim 1 further comprising a disconnector operable to disengage the trigger bar from the sear.

12. The pistol of claim 1, wherein the trigger bar is configured to be self-disconnecting from the sear when the trigger is in the rearward position.

* * * * *